US008624141B2

(12) United States Patent
Schechtel et al.

(10) Patent No.: US 8,624,141 B2
(45) Date of Patent: Jan. 7, 2014

(54) ILLUMINATED BUTTON ASSEMBLY

(75) Inventors: Kevin J. Schechtel, Algonquin, IL (US); Maarten P Menheere, Rotterdam (NL)

(73) Assignee: Happ Controls, Inc., Mount Prospect, IL (US)

( * ) Notice: Subject to any disclaimer, the term of this patent is extended or adjusted under 35 U.S.C. 154(b) by 420 days.

(21) Appl. No.: 12/894,727

(22) Filed: Sep. 30, 2010

(65) Prior Publication Data

US 2012/0080296 A1 Apr. 5, 2012

(51) Int. Cl.
*H01H 9/18* (2006.01)

(52) U.S. Cl.
USPC ..... 200/310; 200/314; 200/341

(58) Field of Classification Search
USPC ..... 200/310–317, 341–345
See application file for complete search history.

(56) References Cited

U.S. PATENT DOCUMENTS

| | | | | |
|---|---|---|---|---|
| 5,077,454 | A | 12/1991 | Lorenzo | |
| 6,590,176 | B2 * | 7/2003 | Cole et al. | 200/341 |
| 7,507,924 | B2 | 3/2009 | Lorenzo Riera et al. | |
| 7,554,047 | B2 | 6/2009 | Verdu et al. | |
| 2003/0226745 | A1 | 12/2003 | Sato et al. | |
| 2007/0246337 | A1 | 10/2007 | Verdu et al. | |
| 2008/0000763 | A1 | 1/2008 | Cove | |
| 2008/0073190 | A1 | 3/2008 | Cove | |
| 2008/0135388 | A1 | 6/2008 | Hoehne et al. | |
| 2009/0036209 | A1 | 2/2009 | Cove | |

FOREIGN PATENT DOCUMENTS

| | | | |
|---|---|---|---|
| AT | 451711 | T | 12/2009 |
| AU | 3980100 | A | 12/2000 |
| AU | 2005293307 | A1 | 4/2006 |
| AU | 2005293311 | A1 | 4/2006 |
| AU | 2007200722 | A1 | 2/2007 |
| AU | 2007201820 | A2 | 4/2007 |
| AU | 2007231802 | A2 | 11/2007 |
| AU | 2008206898 | A1 | 1/2008 |
| DE | 3414009 | A1 | 10/1985 |
| DE | 3811737 | A1 | 10/1989 |
| EP | 1 087 414 | A1 | 3/2001 |
| EP | 1 143 468 | A2 | 10/2001 |
| EP | 1 143 468 | A3 | 4/2003 |
| EP | 1 143 468 | B1 | 2/2006 |
| EP | 1 087 414 | B1 | 8/2007 |
| EP | 1 087 414 | B8 | 8/2007 |
| EP | 1 812 941 | | 8/2007 |
| EP | 1 817 783 | | 8/2007 |
| EP | 1 821 326 | A1 | 8/2007 |
| EP | 1 850 358 | A1 | 10/2007 |
| EP | 1 915 745 | | 4/2008 |
| EP | 1 921 644 | A2 | 5/2008 |
| EP | 1 921 644 | A3 | 2/2009 |
| EP | 2 110 833 | A1 | 10/2009 |
| EP | 1 850 358 | B1 | 12/2009 |

(Continued)

*Primary Examiner* — Amy Cohen Johnson
*Assistant Examiner* — Marina Fishman
(74) *Attorney, Agent, or Firm* — Ladas & Parry LLP

(57) ABSTRACT

Illuminated button assemblies are provided that can be secured to a mounting surface by any of a locking member such as a snap tab, a securing member such as a nut, or a combination of both. The securing member is adapted to enclose the locking member when it is fully secured. A variety of illumination assemblies are similarly sized and shaped such that they can be interchanged within the same assembly housing. A switch and the illumination assembly are directly connected to the assembly housing without the need for a lamp holder.

19 Claims, 7 Drawing Sheets

(56) References Cited

FOREIGN PATENT DOCUMENTS

| | | | |
|---|---|---|---|
| ES | 1010464 | U | 1/1990 |
| ES | 1064635 | U | 4/2007 |
| ES | 2293887 | T3 | 4/2008 |
| ES | 2310436 | A1 | 1/2009 |
| ES | 2310436 | B1 | 11/2009 |
| ES | 2310467 | B1 | 11/2009 |
| GB | 2 310 084 | A | 8/1997 |
| GB | 2 350 481 | A | 11/2000 |
| GB | 2 350 722 | A | 12/2000 |
| GB | 2 354 638 | A | 3/2001 |
| GB | 2 350 722 | B | 10/2002 |
| GB | 2 361 103 | B | 11/2003 |
| GB | 2 441 716 | A | 3/2008 |
| GB | 2 441 716 | B | 5/2009 |
| GB | 2 465 471 | A | 5/2010 |
| GB | 2 465 472 | A | 5/2010 |
| HK | 1112093 | A1 | 8/2009 |
| IT | 219517 | Z2 | 3/1993 |
| JP | 2008-124023 | A | 5/2008 |
| RU | 2007141524 | A | 5/2009 |
| WO | 94/24683 | A1 | 10/1994 |
| WO | 00/74092 | A1 | 12/2000 |
| WO | 2006/040577 | A1 | 4/2006 |
| WO | 2006/040581 | A1 | 4/2006 |
| WO | 2006/067438 | A1 | 6/2006 |
| WO | 2007/003930 | A1 | 1/2007 |
| WO | 2007/093654 | A1 | 8/2007 |
| WO | 2008/087239 | A1 | 7/2008 |
| WO | 2010/058207 | A1 | 5/2010 |
| WO | 2010/058208 | A1 | 5/2010 |

* cited by examiner

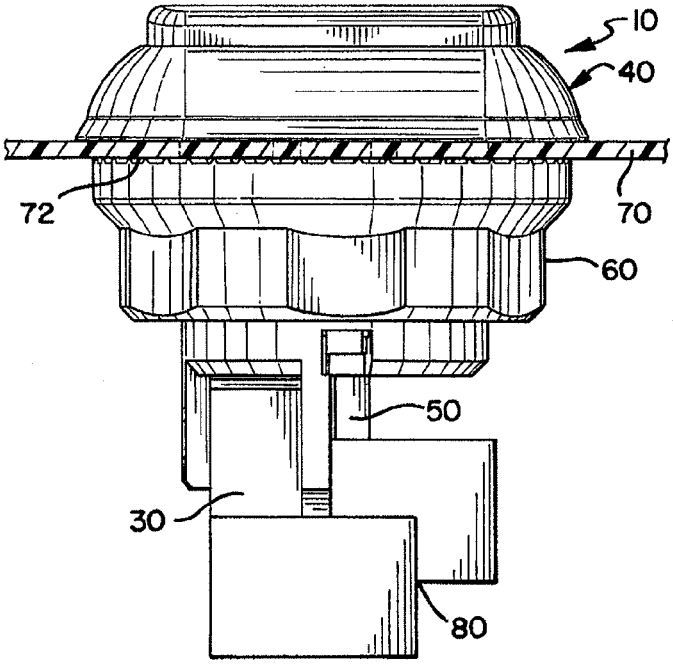
FIG. 10
FIG. 11
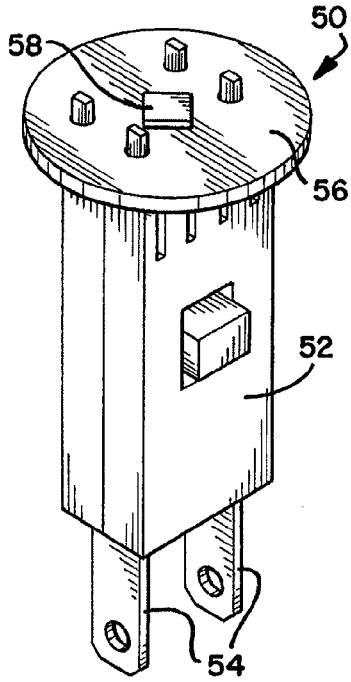
FIG. 12
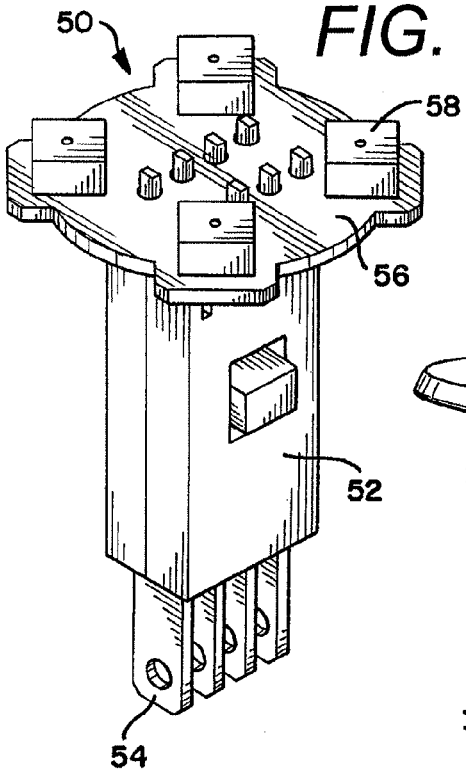
FIG. 13
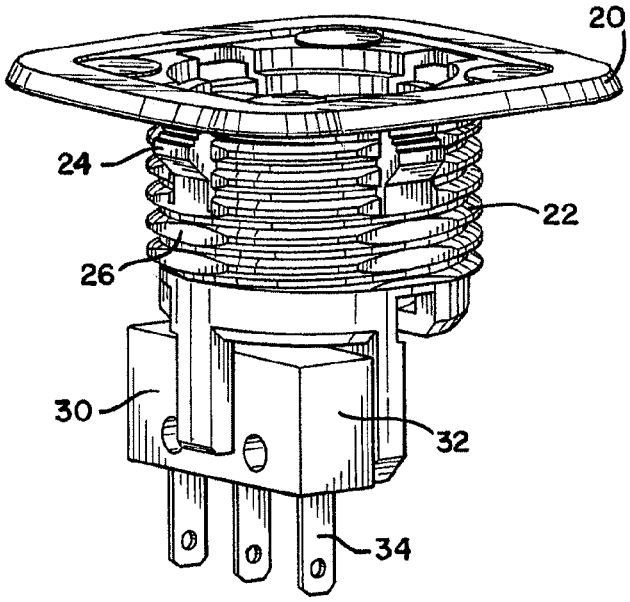

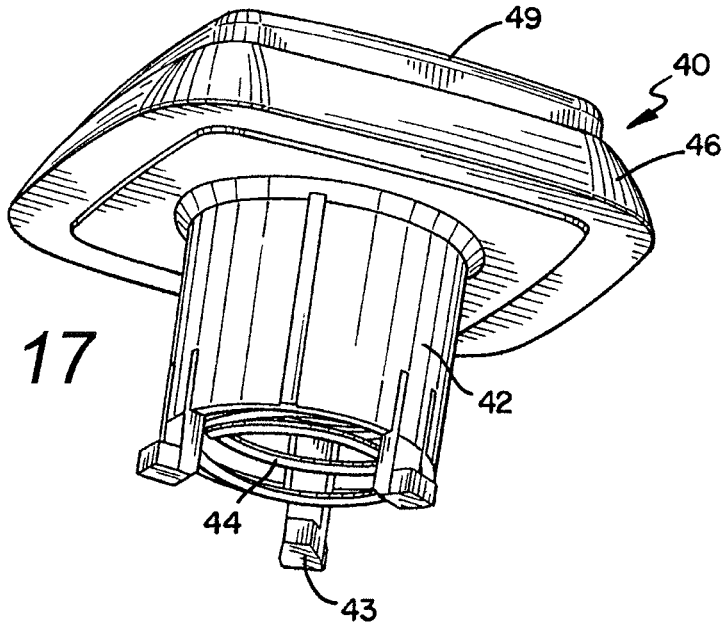
FIG. 17
FIG. 18
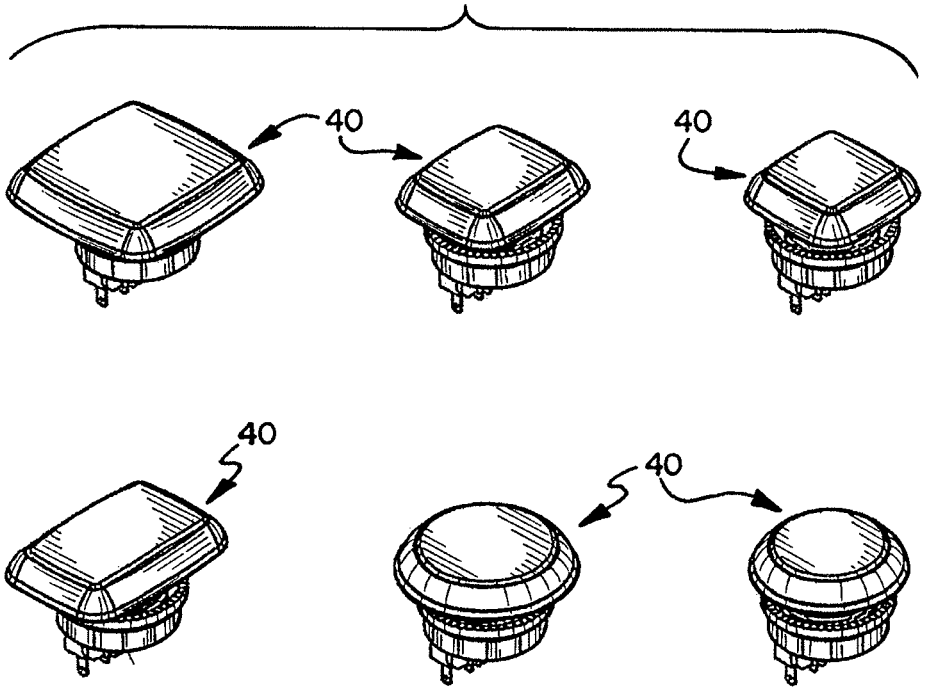

ILLUMINATED BUTTON ASSEMBLY

BACKGROUND OF THE INVENTION

This presently claimed invention generally pertains to illuminated button assemblies that comprise a housing having at least one securing member, a switch, and an illumination member for providing a user with an illuminated means of control. The illuminated buttons, advantageously exhibiting a minimum number of components, can be flexibly secured at the housing by multiple securing options, while having the capability to have the illumination member engage directly with the housing without requiring an intermediary illumination member holder.

DESCRIPTION OF THE BACKGROUND ART

Illuminated buttons have desired features such as illumination of a switch element with flexible assembly options as low manufacturing cost. While illuminated buttons are attractive, there are many aspects in which improvement is sought. For example, there is a desire to secure the illuminated button to a surface such as a panel or a circuit board, typically by using a securing member in some markets, such as Europe, and by using snap features in other markets, such as the United States. There is also a desire to eliminate a separate illumination member holder so that the illumination member is directly engaged with the switch, which is directly engaged with the housing. There is a further desire to provide a conductive connection between the illuminated button and the mounting surface to dissipate static electricity.

Prior art approaches include U.S. Pat. No. 7,507,924. This patent pertains to a lighted module with a pushbutton-type switch assembly. The assembly has a threaded housing which is secured to a mounting surface by a fastening element such as a nut. International Publication No. WO 2010/058207 pertains to a pushbutton assembly having a housing with flexible locking or snap tabs which snap out after passing through an opening in the mounting surface such as a panel in order to secure the pushbutton to the panel. Thus, multiple types of housings are required to provide the same illuminated button to markets with different securing requirements. One solution to overcome this deficiency is to provide a separate spacer that acts as a barrier around the snap features when the securing method requires a securing member to secure the illuminated button housing. This solution requires the manufacture of extra parts which can easily become lost, thus increasing the cost of the illuminated button assembly.

Another prior art approach EP Patent Application No. 1143468 describes an illuminated pushbutton switch assembly having a separate lamp holder that is locked into the housing and engageably receives a lamp and a switch. The lamp holder must have one means for being secured to the housing, another means for securing the switch, and yet another means for securing the lamp. Therefore, extra parts must be manufactured, stored and distributed, thereby increasing the cost of the illuminated button assembly. Further, the lamp holder requires space for locking to the housing, thereby reducing the space available to stabilize the button. In addition, the lamp holder is a complex part that is difficult to change because the tooling is not flexible.

With the present approach, it has been determined that various characteristics of prior art may have shortcomings such as these, and undesirable attributes, results or effects. The present approach recognizes and addresses matters such as these to provide enhancements not heretofore available. Overall, the present approach more fully meets the need to provide a single illuminated button housing that can be secured in a variety of ways as required, that can accommodate a variety of button types, and that can accommodate a variety of illumination members without requiring a separate lamp holder.

SUMMARY OF THE INVENTION

An aspect or embodiment of the invention pertains to an improved illuminated button assembly that comprises an assembly housing having threaded portions for receiving a securing member and further having locking members. The securing member is sized and shaped to be secured to the threaded portions of the assembly housing without damaging the locking tabs in order to facilitate using the same assembly housing in multiple types of mounting designs. For example, the assembly housing may be secured to a panel by pushing the assembly housing through a properly sized and shaped aperture in the panel until the locking tabs snap into place, thereby eliminating the need for a securing member. Alternatively, the assembly housing may be secured to a panel by threading a securing member onto the assembly housing that extends through a panel until the securing member is tightened against the panel. The tightened securing member covers or encloses the locking tabs without damaging them, whether or not the locking tabs are utilized.

In accordance with another aspect or embodiment, an illumination unit is directly engaged by the assembly housing, thereby eliminating the need for a separate lamp holder. The illumination unit can be inserted into a cavity in the assembly housing from the top, for example. This allows for a variety of lighting options using the same size and shape of illumination member housing, such as a simple white LED or a more complex RGB illuminating member, for example. Insertion of the illumination unit from the top also allows for more space to place the illumination members to optimize the lighting. For example, the outer edges of very large buttons can now be optimally illuminated by placing illumination members wider apart. In addition, the elimination of the lamp holder creates more space within the assembly housing, thereby allowing for improved button stability. For example, there can be three latches on the bottom of the activating member properly position the activating member in the assembly housing and ensuring that the switch is activated when the button is pressed.

In accordance with another aspect or embodiment, the switch is also directly engaged by the assembly housing, eliminating the need for the switch to be held in place by a lamp holder. The switch can be connected to the assembly housing by any industry standard method of attachment, such as latches, snap tabs or a friction fit, for example. Therefore, the switch becomes an integral component of the assembly housing, yet can be easily removed and replaced by a new switch as desired.

It is the intention of at least one embodiment of the invention to provide an illuminated button assembly including: an assembly housing having a threaded portion and a locking member, a switch, a moveable button assembly, and an illumination assembly. In an aspect of the invention, the illuminated button assembly further includes a securing member for securing the assembly housing to a mounting surface. In another aspect of the invention, the securing member has a mating portion for engaging the threaded portion of the assembly housing and a flanged portion extending radially beyond the locking member, such that the flanged portion encloses the locking member when the securing member is secured against the mounting surface.

In yet another aspect of the invention, the flanged portion is sized and shaped such that there is no contact between the flanged portion and the locking member. In another aspect of the invention, the flanged portion is sized and shaped such that the flanged portion contacts but does not compress the locking member. In still another aspect of the invention, the flanged portion is sized and shaped such that the flanged portion compresses the locking member without releasing the locking member from the mounting surface. In another aspect of the invention, the assembly housing has multiple threaded portions with non-threaded portions therebetween. In yet another aspect of the invention, the locking member is positioned in a non-threaded portion. In another aspect of the invention, the assembly housing has multiple locking members.

It is the intention of another embodiment of the invention to provide an illuminated button assembly including: an assembly housing, a switch directly connected to the assembly housing, a moveable button assembly, and an illumination assembly. In an aspect of the invention, the illumination member is a Light Emitting Diode (LED). In another aspect of the invention, the illumination assembly is directly connected to the assembly housing. In yet another aspect of the invention, the moveable button assembly comprises a plunger and wherein the plunger has at least three orientation members for positioning the plunger within the assembly housing. In another aspect of the invention, the illumination assembly overlaps with the plunger within the assembly housing.

It is the intention of yet another embodiment of the invention to provide a method of assembling an illuminated button assembly including the steps of: connecting a switch to an assembly housing, the assembly housing having a threaded portion and a locking member, connecting an illumination assembly to the assembly housing, and connecting a moveable button assembly to the assembly housing. In an aspect of the invention, the method includes the additional steps of placing a portion of the assembly housing through a mounting surface and securing the assembly housing against the mounting surface using at least one of the locking member and a securing member.

In another aspect of the invention, using a securing member includes advancing the securing member onto the threaded portion until the securing member is secured against the mounting surface, wherein the securing member includes a mating portion for engaging the threaded portion of the assembly housing, and a flanged portion extending radially beyond the locking member, such that the flanged portion at least partially encloses the locking member when the securing member is secured against the mounting surface. In yet another aspect of the invention, the switch and the illumination assembly are directly connected to the assembly housing without using a lamp holder. In still another aspect of the invention, the assembly housing is sized and shaped to accommodate one of a single white light emitting diode (LED) illumination assembly and a multiple LED red, green, blue (RGB) illumination assembly.

BRIEF DESCRIPTION OF THE DRAWINGS

FIG. 10 is a side view of the illuminated button assembly of FIG. 1 attached to a panel using the securing member of FIG. 6;

FIG. 11 is a perspective view of an embodiment of an illumination assembly;

FIG. 12 is a perspective view of another embodiment of an illumination assembly;

FIG. 13 is a perspective view of the assembly housing of FIG. 4 with a switch attached;

FIG. 17 is a perspective view of an embodiment of a button assembly; and

FIG. 18 is a perspective view of a variety of button assembly sizes and shapes.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 2:
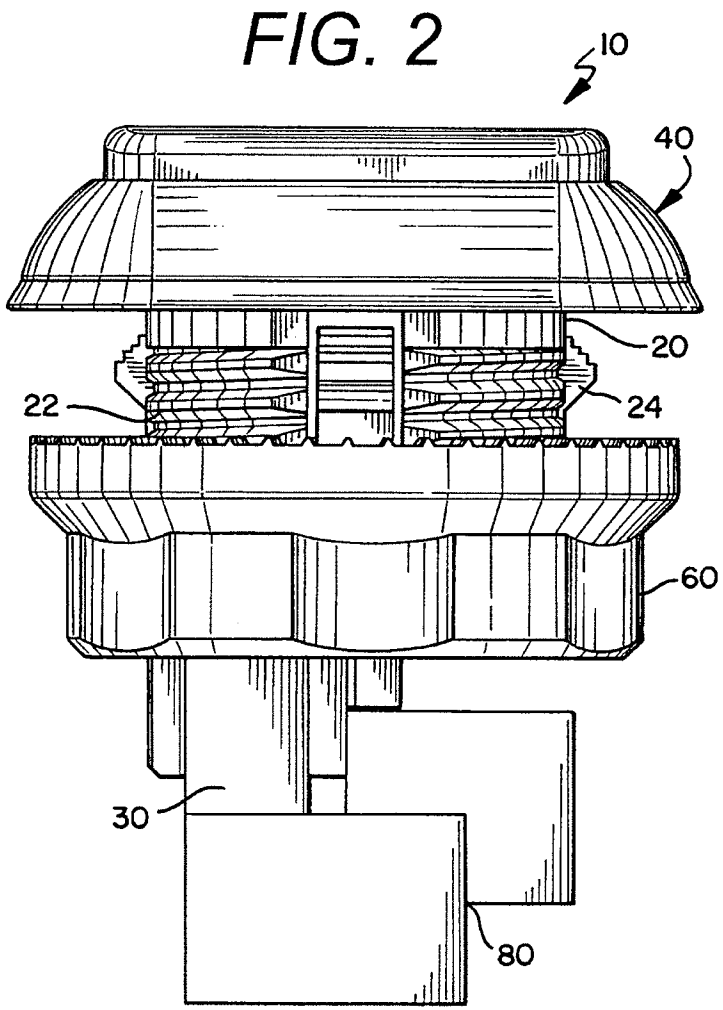
FIG. 2 is a side view of the illuminated button assembly of FIG. 1.
Figure 1:
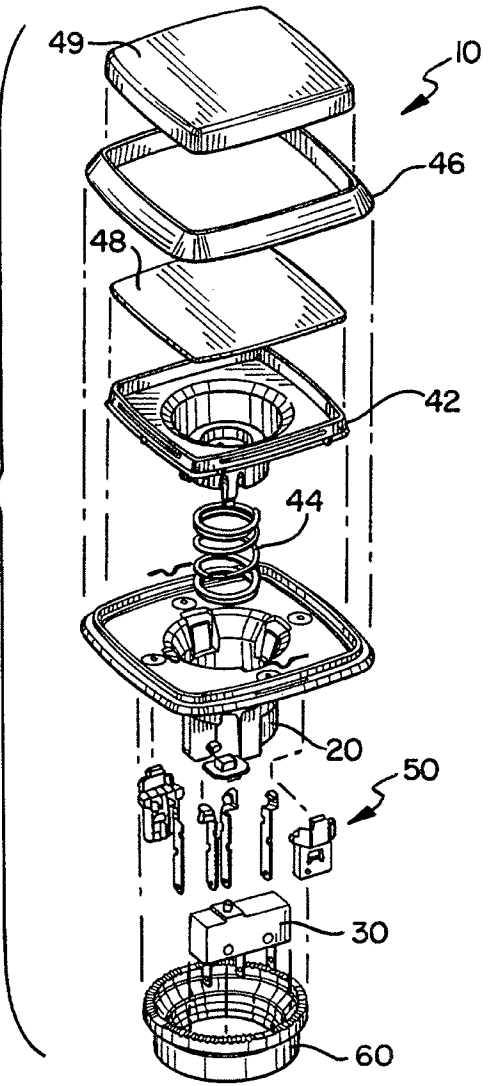
FIG. 1 is an exploded perspective view of an embodiment of an illuminated button assembly.
Figure 3:
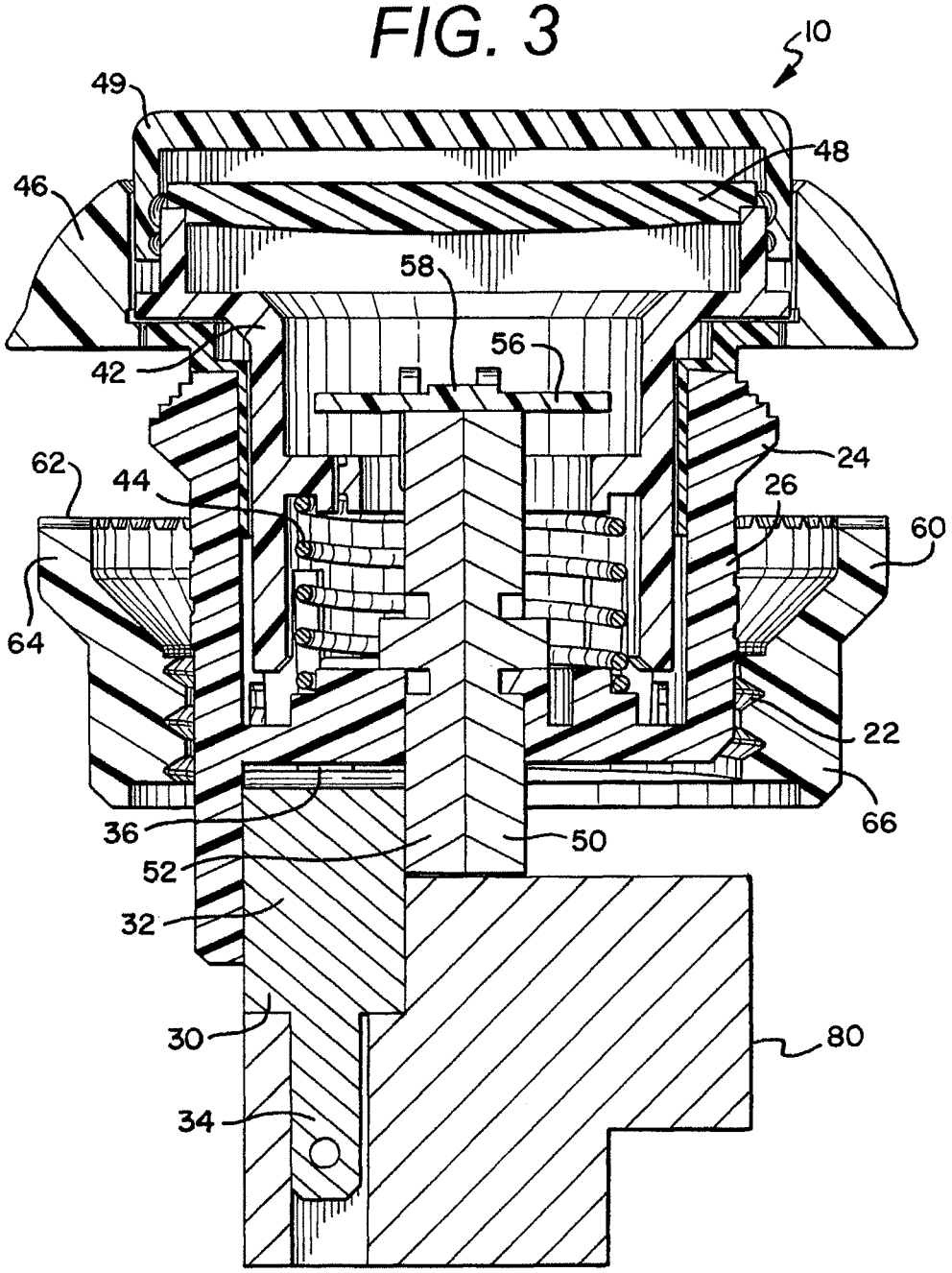
FIG. 3 is a cross-sectional side view of the illuminated button assembly of FIG. 1.
Figure 4:
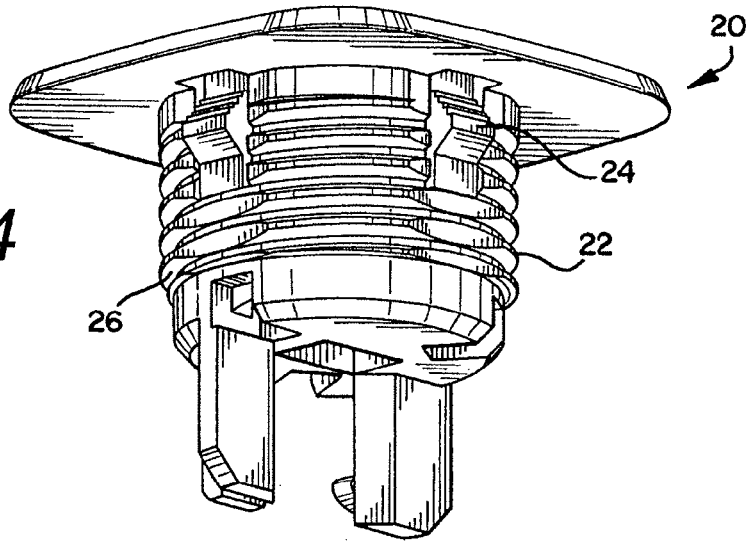
FIG. 4 is a perspective view of an embodiment of an assembly housing.
Figure 5:
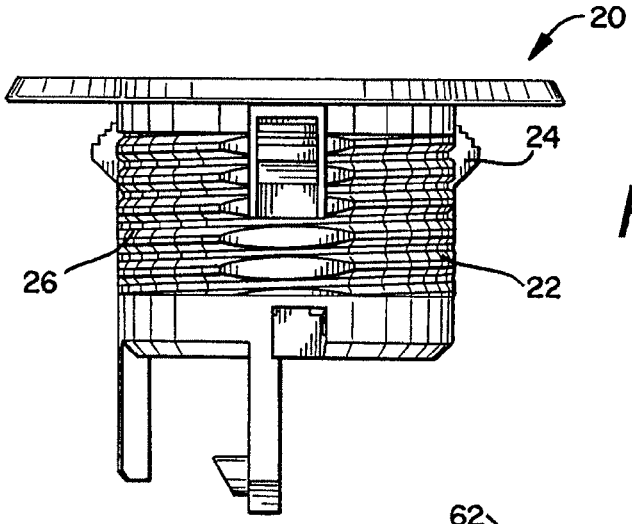
FIG. 5 is a side view of the assembly housing of FIG. 4.
Figure 6:
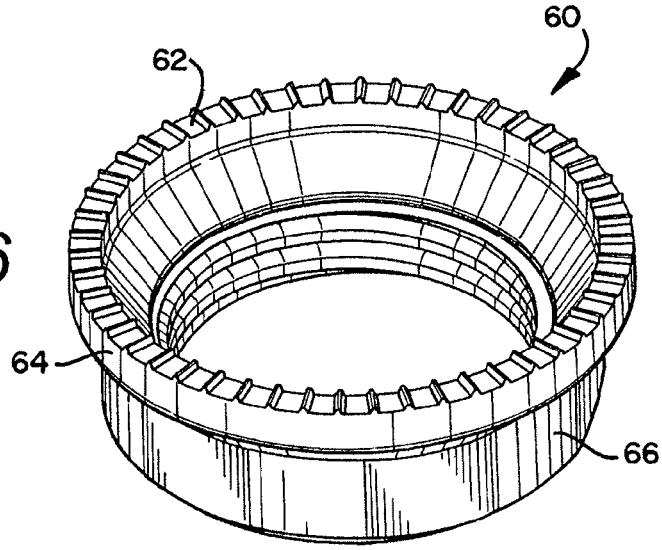
FIG. 6 is a perspective view of an embodiment of a securing member.
Figure 7:
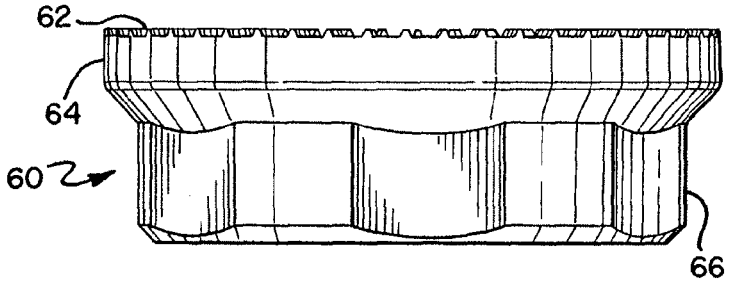
FIG. 7 is a side view of the securing member of FIG. 6.
Figure 8:
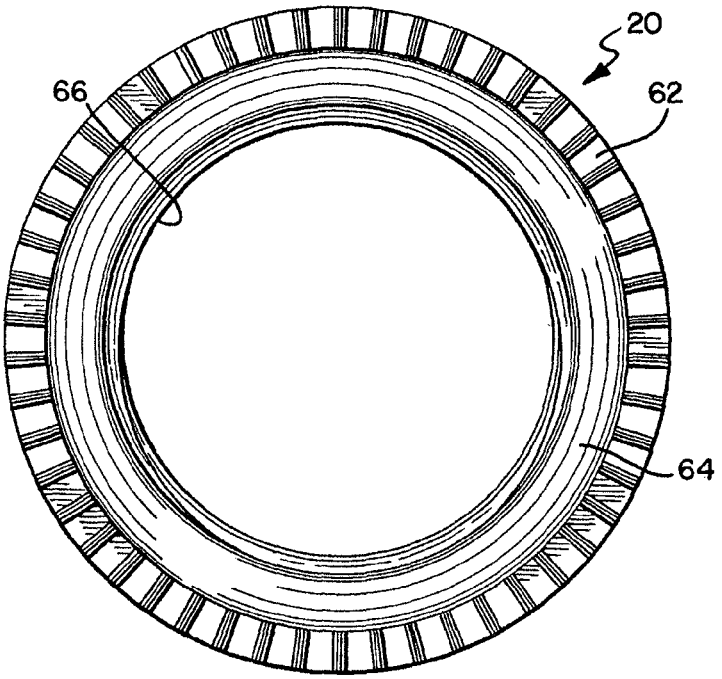
FIG. 8 is a top plan view of the securing member of FIG. 6.

FIGS. 1-3 represent an embodiment of an illuminated button assembly, generally designated as 10. Illustrated illuminated button assembly 10 comprises an assembly housing 20, a switch 30, a button assembly 40, and an illumination assembly 50. As seen in FIG. 4, assembly housing 20 has at least one threaded portion 22 and at least one locking member 24. Assembly housing 20 may be formed of any industry standard material such as metal, plastic or a composite, for example. Threaded portion 22 allows for a securing member 60, such as a nut or a wing nut for example, to be threadably mated with threaded portion 22 in order to secure the illuminated button assembly 10 to a mounting surface 70 as seen in FIG. 10. The mounting surface 70 may be any industry standard surface such as a panel, a bezel or a washer, for example. The mounting surface 70 may be formed of any industry standard material such as metal, plastic or a composite, for example.

Figure 9:
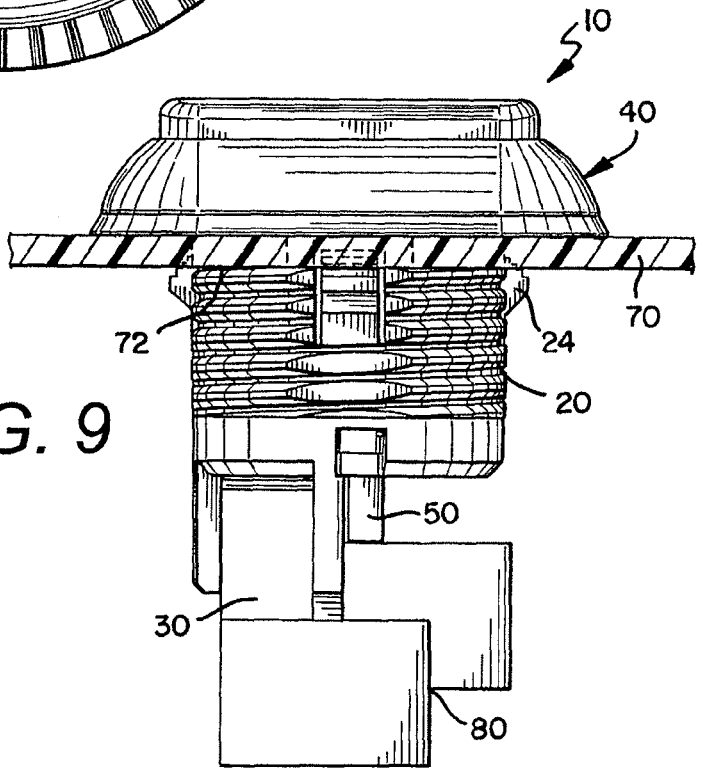
FIG. 9 is a side view of the illuminated button assembly of FIG. 1 attached to a panel using locking members.
Figure 14:
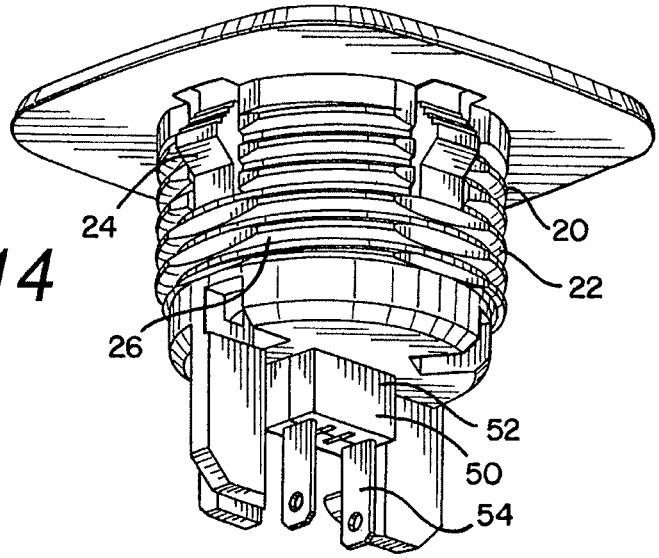
FIG. 14 is a perspective view of the assembly housing of FIG. 4 with an illumination assembly attached.
Figure 15:
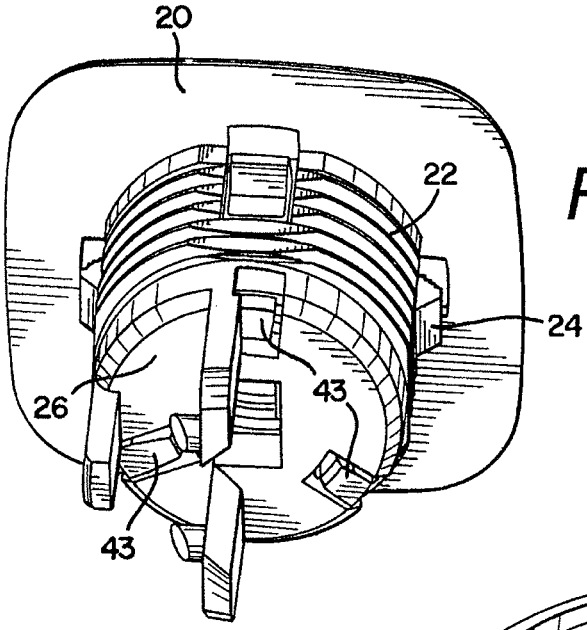
FIG. 15 is a perspective view of the assembly housing of FIG. 4 with a moveable member attached.

Illuminated button assembly 10 may alternatively be secured to mounting surface 70 by locking member 24 without the use of securing member 60, as seen in FIG. 9. For example, locking member 24 may be a snap tab that flexes inward as the assembly housing 20 is passed through an aperture 72 in mounting surface 70 and that snaps back after clearing the mounting surface 70, such that it prevents assembly housing 20 from being retracted back through aperture 72 in mounting surface 70. Alternatively, locking member 24 may be any other industry standard restraining member such as a latch or a hook, for example. Locking member 24 may be formed of any industry standard material such as metal, plastic or a composite, for example. Assembly housing 20 may have any number of locking members 24 as desired. The illustrated assembly housing 20 has four locking members, for example.

Illuminated button assembly 10 may be secured to mounting surface 70 by both locking member 24 and securing device 60. As before, assembly housing 20 is inserted through aperture 72 until locking member 24 flexes back into locking position, thereby securing assembly housing 20 to mounting surface 70. A mating portion 66 of securing member 60 is then threadably mated with threaded portion 22 until an engaging portion 62 of securing member 60 is secured against a surface of the mounting surface 70, securing illuminated button assembly 70. An extended portion 64 of securing member 60 extends radially outward from mating portion 66 such that securing member 60 can fit over locking member 24. Extended portion 64 may be sized and shaped such that securing member 60 does not contact locking member 24 when securing member 60 is secured against mounting surface 70, for example. Alternatively, extended portion 64 may be sized and shaped such that locking member 24 is contacted but not compressed, slightly compressed or fully compressed when securing member 60 is secured against mounting surface 70.

As seen in FIG. 13, switch 30 is directly connected to assembly housing 20, thereby eliminating the need for a lamp holder as an intermediary connection between the switch 30 and the assembly housing 20. Switch 30 may be attached by the use of any industry standard attachment method, such as latches, snap tabs or a friction fit, for example. Switch 30 may be any industry standard or custom switch that may include a switch housing 32, switch contacts 34 and an activation member 36 for engaging and disengaging with the contacts, for example. The engaging and disengaging of the switch contacts allows the illumination assembly to be turned on and off.

An illustrated embodiment of button assembly 40 is seen in FIGS. 1 and 17. Illustrated button assembly 40 comprises a plunger 42, a spring 44, a button bezel 46, a legend plate 48, and a lens cap 49, for example. Plunger 42 is sized and shaped to slidably move within a shaft 26 of assembly housing 20. Plunger 42 may have any desired number and type of orientation members 43 to enable plunger 42 to properly be positioned within shaft 26. For example, the illustrated plunger 42 has three hooks 43 on the bottom of the plunger as seen in FIG. 17, thereby ensuring improved button stability. Button stability is important to ensure that switch 30 is consistently activated when the button is pressed by a user. Alternatively, orientation member 43 can be a guiding ring, a bump, or a guiding slot, for example. Illustrated orientation member 43 contacts activation member 36 of switch 30 when button assembly 40 is pushed down by the user, thereby turning the illumination assembly 50 on or off. Button assembly 40 can be sized and shaped as desired. For example, button assembly 40 can be round, square or rectangular, and can be small or large, as can be seen in FIGS. 18A-18E.

As seen in FIGS. 11 and 12, illumination assembly 50 comprises a terminal housing 52, terminals 54, a substrate 56, and an illumination member 58. Terminal housing 52 is sized and shaped to be attached to assembly housing 20 by any industry standard method such as latches, tabs, tongue and groove, or friction fit, for example. Illustrated terminal housing 52 is sized and shaped to provide a variety of illumination options without having to change the dimensions of terminal housing 52. For example, the same size and shape terminal housing 52 can be used for an illumination assembly having two terminals 54 with a single illumination member 58 as seen in FIG. 11, or having four terminals 54 with four illumination members as seen in FIG. 12. Illumination member 58 can be any industry standard illumination device such as an incandescent light bulb or a light emitting diode (LED), for example. Illustrated illumination member 58 of FIG. 11 is a simple white LED while illustrated illumination members 58 if FIG. 12 are multiple LEDs forming a more complex RGB version.

Figure 16:
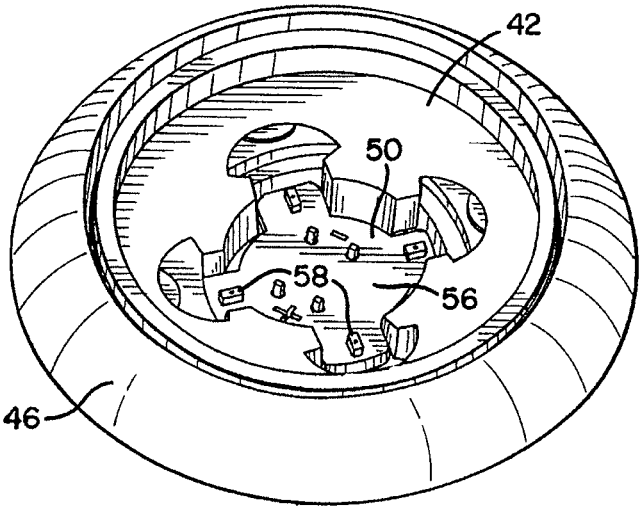
FIG. 16 is a top plan view of the illuminated assembly of FIG. 1 with the legend plate and lens cap removed.

Illumination assembly 50 is inserted into assembly housing 20 from the top of button assembly 40 when legend plate 48 and lens cap 49 are removed. Therefore, illumination assembly 50 can overlap with plunger 42 as seen in FIG. 16. This allows illumination members 58 to be placed further apart upon substrate 56, thereby illuminating the edges of lens cap 49 more effectively and minimizing having a bright spot in the middle of lens cap 49, particularly for large button assemblies 40.

Illuminated button assembly 10 may also include a terminal connector 80 as seen in FIG. 2. Terminal connector 80 is sized and shaped to receive switch contacts 34 of switch 30 and terminals 54 of illumination assembly 50, thereby providing electrical connections to switch 30 and illumination assembly 50. Alternatively, illuminated button assembly 10 may have separate terminal connectors 80 for connecting to switch 30 and illumination assembly 50 respectively. Terminal connector 80 may be connected to a controller, a printed circuit board, or a power supply, for example.

It will be understood that there are numerous modifications of the illustrated embodiments described above which will be readily apparent to one skilled in the art, such as variations and modifications of the illuminated button assembly and/or its components including combinations of features disclosed herein that are individually disclosed or claimed herein, explicitly including additional combinations of such features, or alternatively other types of illuminated button assemblies. For example, illuminated button assemblies can have activation mechanisms other than a pushbutton, such as a rocker switch or a proximity switch. Also, there are many possible variations in the materials and configurations. These modifications and/or combinations fall within the art to which this invention relates and are intended to be within the scope of the claims, which follow.

The invention claimed is:

1. An illuminated button assembly, comprising:

an assembly housing having a threaded portion and a locking member, the locking member being configured to secure the illuminated button assembly to a mounting surface;

a switch;

a moveable button assembly; and an illumination assembly, wherein the threaded portion and the locking member are disposed on an outer side surface of the assembly housing, and the locking member comprises a compressible locking tab configured to flex inward as the assembly housing is passed through a properly sized aperture in the mounting surface and to snap back after clearing the mounting surface.

2. The illuminated button assembly of claim 1, further comprising a securing member for securing the assembly housing to the mounting surface by engaging with the threaded portion.

3. The illuminated button assembly of claim 2, wherein the threaded portion and the locking member are disposed on an outer side surface of the assembly housing, and the securing member comprises a mating portion for engaging the threaded portion of the assembly housing, and a flanged portion extending radially outward away from the mating portion so as to extend beyond the locking member, such that the flanged portion encloses the locking member when the securing member is secured against the mounting surface.

4. The illuminated button assembly of claim 3, wherein the flanged portion is sized and shaped such that there is no contact between the flanged portion and the locking member.

5. The illuminated button assembly of claim 3, wherein the flanged portion is sized and shaped such that the flanged portion contacts but does not compress the locking member.

6. The illuminated button assembly of claim 3, wherein the flanged portion is sized and shaped such that the flanged portion compresses the locking member without releasing the locking member from the mounting surface.

7. The illuminated button assembly of claim 1, wherein the assembly housing has multiple threaded portions on an outer side surface of the assembly housing with non-threaded portions of the outer side surface being interposed between the threaded portions.

8. The illuminated button assembly of claim 7, wherein the locking member is positioned on a non-threaded portion of the outer side surface.

9. The illuminated button assembly of claim 1, wherein the assembly housing has multiple threaded portions and multiple locking members, wherein each locking member is interposed between any two of the multiple threaded portions.

10. The illuminated button assembly of claim 1, wherein the assembly housing has multiple threaded portions on the outer side surface of the assembly housing with non-threaded portions of the outer side surface being interposed between the threaded portion, and the assembly housing has multiple locking members each disposed on one of the non-threaded portions such that each of the multiple locking members is interposed between two of the threaded portions.

11. An illuminated button assembly, comprising:

an assembly housing;

a switch directly connected to the assembly housing;

a moveable button assembly; and an illumination assembly, wherein the assembly housing has a first end in which the movable button assembly is inserted and a second end opposite the first end, and the assembly housing comprises fins extending outwardly from the second end in a direction opposite the first end, the fins engaging with the switch such that the switch is directly connected to the assembly housing.

12. The illuminated button assembly of claim 11, wherein the illumination assembly comprises:

a terminal housing;

a terminal;

a substrate; and an illumination member.

13. The illuminated button assembly of claim 12, wherein the illumination member is a Light Emitting Diode (LED).

14. The illuminated button assembly of claim 11, wherein the illumination assembly is directly connected to the assembly housing.

15. The illuminated button assembly of claim 11, wherein the moveable button assembly comprises a plunger, wherein the plunger has at least three orientation members for positioning the plunger within the assembly housing.

16. The illuminated button assembly of claim 15, wherein the illumination assembly overlaps with the plunger within the assembly housing.

17. A method of assembling an illuminated button assembly, comprising the steps of:

connecting a switch to an assembly housing, the assembly housing having a threaded portion and a locking member, the assembly housing having a first end in which a moveable button assembly is inserted;

connecting an illumination assembly to the assembly housing by inserting the illumination assembly through the first end of the assembly housing and into a cavity in the assembly housing;

connecting the moveable button assembly to the assembly housing placing a portion of the assembly housing through a mounting surface; and securing the assembly housing against the mounting surface using at least one of the locking member and a securing member, wherein using a securing member comprises advancing the securing member onto the threaded portion until the securing member is secured against the mounting surface, wherein the securing member comprises a mating portion for engaging the threaded portion of the assembly housing, and a flanged portion extending radially beyond the locking member, such that the flanged portion at least partially encloses the locking member when the securing member is secured against the mounting surface.

18. The method of assembling an illuminated button assembly of claim 17, wherein the switch and the illumination assembly are directly connected to the assembly housing without using a lamp holder.

19. The method of assembling an illuminated button assembly of claim 17, wherein the assembly housing is sized and shaped to accommodate either one of a single white light emitting diode (LED) illumination assembly and a multiple LED red, green, blue (RGB) illumination assembly without changing the assembly housing.

* * * * *